US006315083B1

(12) United States Patent
Schuster et al.

(10) Patent No.: US 6,315,083 B1
(45) Date of Patent: Nov. 13, 2001

(54) TRANSPORTATION SYSTEM CONTROL WITH USER INPUT OF TRAVEL DESTINATION DESIGNATIONS

(75) Inventors: Kilian Schuster, Ballwil; Paul Friedli, Remetschwil, both of (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/537,652

(22) Filed: Mar. 29, 2000

(30) Foreign Application Priority Data

Apr. 1, 1999 (EP) ..... 99810279

(51) Int. Cl.[7] ..... B66B 3/00

(52) U.S. Cl. ..... 187/391; 187/395; 187/396; 187/380

(58) Field of Search ..... 127/391, 380, 127/394, 382, 396, 388, 398, 399, 395

(56) References Cited

U.S. PATENT DOCUMENTS

| | | | | |
|---|---|---|---|---|
| 4,749,062 | * | 6/1988 | Tsuji et al. | 187/139 |
| 4,852,696 | * | 8/1989 | Fukuda et al. | 187/139 |
| 4,989,694 | * | 2/1991 | Ueshima et al. | 187/121 |
| 5,042,620 | * | 8/1991 | Yoneda et al. | 187/124 |
| 5,382,761 | * | 1/1995 | Amano | 187/383 |
| 5,679,934 | | 10/1997 | Juntunen et al. . | |
| 5,789,715 | * | 8/1998 | Kakko et al. | 187/397 |
| 5,831,226 | * | 11/1998 | Hattori et al. | 187/382 |
| 6,062,346 | | 5/2000 | Friedli et al. . | |
| 6,065,570 | * | 5/2000 | Friedl et al. | 187/387 |

FOREIGN PATENT DOCUMENTS

| | | | |
|---|---|---|---|
| 0 320 583 | | 6/1989 | (EP) . |
| 0 864 528 | | 9/1998 | (EP) . |
| 2 241 090 | | 8/1991 | (GB) . |
| 6-321445-A | * | 6/1994 | (JP) . |
| 02158571-A | * | 6/1990 | (JP) ..... 187/391 |

* cited by examiner

*Primary Examiner*—Jonathan Salata
(74) *Attorney, Agent, or Firm*—MacMillan, Sobanski & Todd, LLC

(57) ABSTRACT

A user communicates travel destinations to a transportation system utilizing a human-machine interface having a touch screen with a selection of designations that can be individually selected by touching the screen. For example, a selected designation "Library" is communicated from the human-machine interface to a transportation system control without the user knowing where the library is actually located. The control determines the real locational parameter of the travel destination from a table storage device containing the designations and the associated real locational parameters. The control assigns the desired travel destination, such as a floor, to vehicle, such as an elevator car, with the best travel conditions and informs the user of the assigned vehicle on the touch screen. The information displayed to the user can include a vehicle identification, a travel destination identification, instructions and an indication of the place of boarding.

11 Claims, 1 Drawing Sheet

TRANSPORTATION SYSTEM CONTROL WITH USER INPUT OF TRAVEL DESTINATION DESIGNATIONS

BACKGROUND OF THE INVENTION

The present invention relates a method of communication with a transportation system which, for the purpose of entering travel destinations and for communicating information to the user, has at least one human-machine interface.

The EP patent specification 0 320 583 shows devices for registering and displaying calls for elevators which devices are located on the landings and have a group control device with immediate assignment of destination calls. Each device for registering and displaying calls having a decimal keypad for entering calls for desired destination floors and a display field for displaying the desired floor and the assigned elevator car.

A disadvantage of the known device is that the human-machine communication is based on floor numbers. To select the correct floor, the user of the elevator installation must know the infrastructure on the respective floors. He must know, for example, that the restaurant is on the fourth floor, or the taxation department on the eighth floor. Only thus can the user select the correct floor number.

SUMMARY OF THE INVENTION

The present invention solves the task of avoiding the disadvantages of the known device, and proposes a method of facilitating the use of a transportation system. The main advantages achieved by the invention are that the man-machine communication is simplified.

The user of the means of transportation does not need to have any knowledge, in the conventional sense, about his travel destination. For example, functional information about the user's travel destination is sufficient. The user need not specify a location. The machine, or more precisely, the control of the transportation system, supplies the user with the necessary information. Entering the travel destination can be done more rapidly, the means of transportation regarded as a whole thereby being able to work more efficiently, especially when there is heavy traffic.

Additional information can be communicated to the user relating, for example, to his travel destination, such as the opening times of counters or shops, or information for finding the way. This makes it possible to avoid unnecessary trips or detours. Further, users can be characterized and classified according to their travel destinations, the way of executing the travel wishes being adaptable to the respective user or group of users. Attributes such as, for example, urgency, space requirements, or loading/unloading time, can be used when the travel request is executed.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
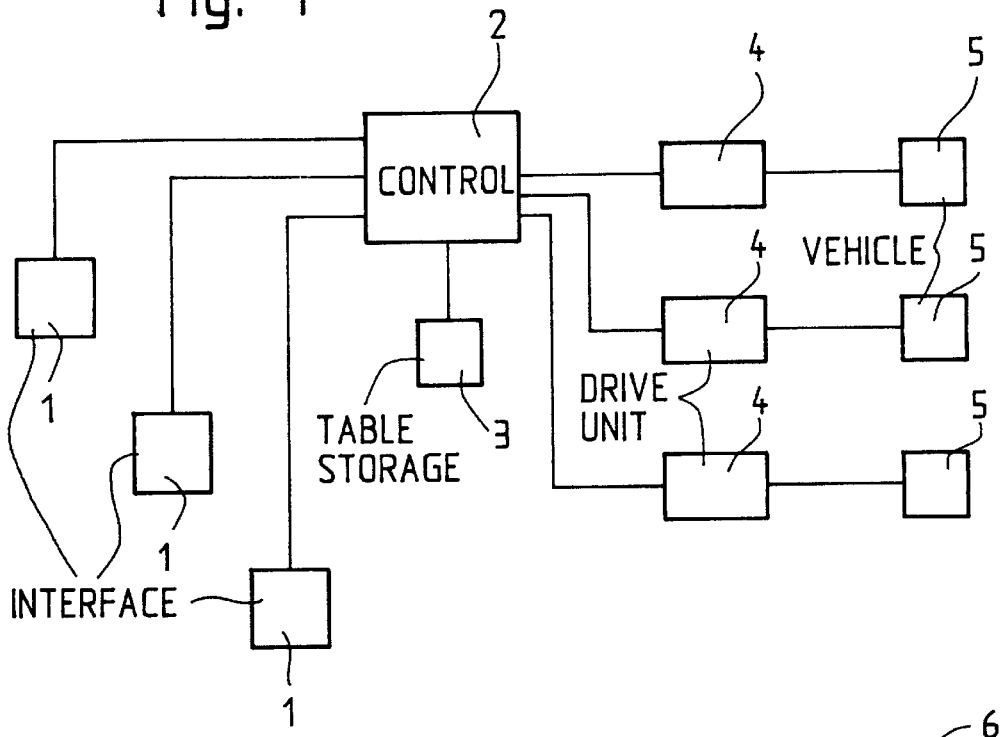
FIG. 1 is a schematic block diagram of a transportation system having several vehicles and operating in accordance with the present invention.
Figure 2:
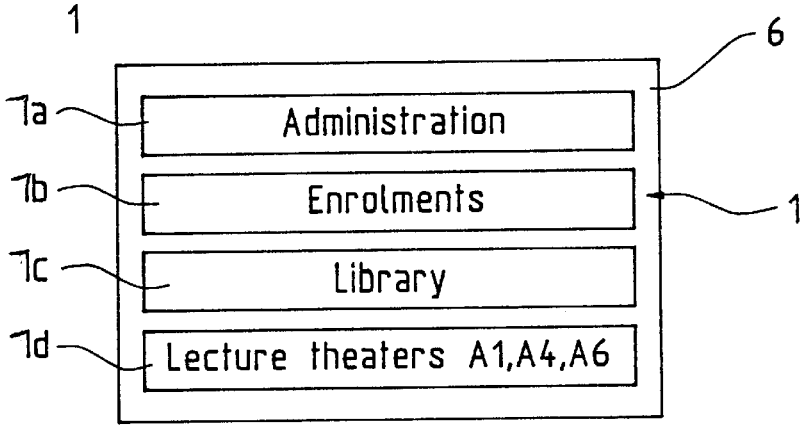
FIG. 2 shows a designation display screen of one of the human-machine interfaces of FIG. 1.
Figure 3:
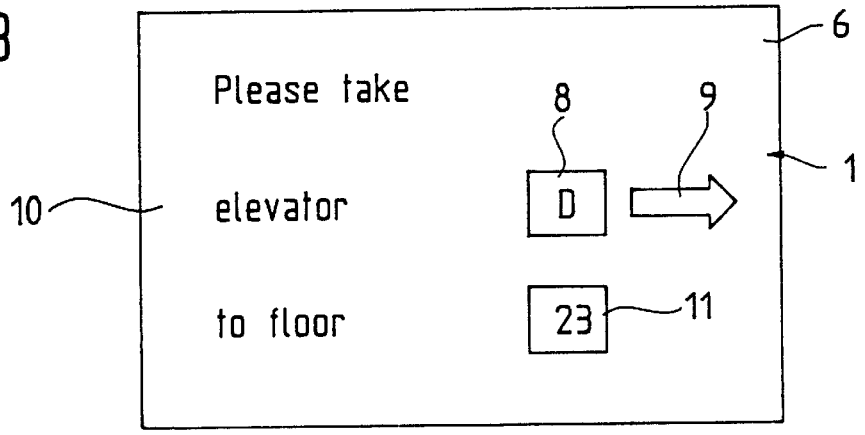
FIG. 3 shows an information display screen of one the human-machine interfaces of FIG. 1.

In FIGS. 1 to 3, there is shown a human-machine interface 1 by means of which a user communicates his travel destination to a control of a transportation system. FIG. 1 shows a transportation system having a control 2, consisting in essence of a processor and memory, that has access to a source of information in the form of, for example, a connected table storage device or means 3 containing the real locational parameters of the available travel destinations and the designations assigned to the locational parameters. Also connected to the control 2, either by wire or wireless, are several of the human-machine interfaces 1. The transportation system can, for example, be an elevator system with at least one elevator hoistway, in which several vehicles 5, specifically elevator cars, travel with a high degree of autonomy, and the direction of movement can be vertical and/or horizontal. In the simplest case, the transportation system comprises an elevator with one or more elevator cars 5, each elevator hoistway having one elevator car traveling in it. Connected to the control 2 are drive units 4 to control and supply associated ones of the vehicles 5, specifically the elevator cars.

FIG. 2 shows one of the human-machine interfaces 1 having a touch-screen 6. Instead of the touch screen there can be a keypad with a screen. In the simplest case, appropriately labeled keys are sufficient. Displayed on the screen 6 is a designation display including a plurality of soft keys 7*a* through 7*d* representing a selection of travel destinations, relating in the example to a university, which can be individually selected by touching the screen. Further travel destinations can be called up using window or scrolling techniques. The travel destinations are not indicated as real locational parameters such as a floor number, for example, but as designations which, for example, functionally describe the travel destination. For example, the user touches the soft key 7*a* to select the "Administration" offices as his travel destination, without knowing the actual location of the "Administration" offices. Following selection of the travel designation, the human-machine interface 1 signals the selected designation to the control 2 which can request further information from the user, for example his registration number. If the destination is, for example, a company, the user is pre-announced at the company's reception desk and can thus be attended to more courteously and promptly.

Further examples of applications are hospitals or hotels, where a wide range of different travel commands from continuously new users have to be executed. Based on the designation, operating rooms or VIP lounges can be served with higher priority than other rooms on the same floor. The elevator users need no knowledge of the building organization or layout, which is often complex. With the easily remembered designations, even users with no knowledge of the building easily find their way.

The real locational parameter associated with the designation is determined by the control 2 by means of the information stored in the table storage means 3 in which, for example, the designation "Administration" is assigned to the real locational parameter "Floor 23". The control 2 assigns to the desired floor the elevator car with the best travel conditions, and informs the user with an information display on the touch screen 6 as shown in FIG. 3. The information contains the designation of the means of transportation, in the present case the elevator car "D" in a vehicle identification area 8, and an indication of the place of boarding, in the present case a direction arrow in a direction arrow area 9 to the right. The displayed information also can include an instruction "Please take elevator to floor" in an information instruction area 10 and the floor number "23" in a travel destination identification area 11. Further, where there are elevator cars having multiple doors, the information includes the side of the door, or where transportation systems transport horizontally and/or vertically, it includes the coordinates of the place of boarding. The coordinates of the place of boarding and/or leaving can be used generally. On transportation systems where one stopping place is served by more than one vehicle, the information can also include a vehicle designation.

During the trip, the travel destinations being traveled to are indicated on the screen 6, using the real locational parameters and/or the designations.

Depending on the use of the building, the table 3 can be changed with time. For example, if a room is used during the daytime as a conference room and in the evenings as a ballet hall, the corresponding designation is adapted to the use of the room. Thus, the information stored in the table 3 can be related to a clock signal from the control 2. The selection of travel destinations can also depend on the respective place of boarding or floor, or there can be an adapted or restricted table for each place of boarding. The table 3 can also be dependent on the momentary position of the user or the goods to be transported. Also, the control 2 can characterize the users based upon the designations and operate accordingly. For example, all users who select the same travel destination can be directed to the same vehicle. As another example, a user going to the emergency room in a hospital can be directed to an empty elevator and other users directed away from that elevator. Other designations that are easily remembered and have an association with the travel destination, for example names, telephone numbers, children's words for kindergartens, pictures, symbols, pictographs, reference numbers, signs, etc., are also possible.

For translating the designations, instead of the table 3, a search can be made in a network for a source of information that assigns to the designation a real locational parameter.

Use of the means of transportation can be made dependent on a confirmation of the selected travel destination. The confirmation can be issued for each user individually. For this purpose, means of communication such as telephone, video telephone, e-mail, etc. can be used.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of communication of travel destination information between users and a transportation system comprising the steps of:

a. providing a human-machine interface;

b. providing a transportation system control;

c. storing real locational parameters of available travel destinations served by the transportation system and designations assigned to the locational parameters;

d. entering one of the designations into the human-machine interface and communicating the one designation from the human-machine interface to the control; and e. operating the control to identify at least one of the stored real locational parameters assigned to the one designation for controlling the transportation system for use in moving the user to the travel destination represented by the at least one real locational parameter.

2. The method according to claim 1 wherein the real locational parameters and the designations assigned to the real locational parameters are stored in a storage means connected to the control of the transportation system.

3. The method according to claim 1 including a step of identifying the at least one stored real locational parameter based upon a current time of day.

4. The method according to claim 1 including a step of assigning a transportation vehicle to a user of the human-machine interface and displaying to the user through the human-machine interface vehicle identification information associated with the assigned vehicle.

5. The method according to claim 1 including a step of assigning a transportation vehicle to a user of the human-machine interface and displaying to the user through the human-machine interface an indication of a place of boarding associated with the assigned vehicle.

6. The method according to claim 1 including a step of displaying to a user of the human-machine interface through the human-machine interface an instruction associated with the one designation.

7. The method according to claim 1 including a step of displaying to a user of the human-machine interface through the human-machine interface a travel destination identification associated with the one designation.

8. The method according to claim 1 including a step of characterizing the user on the basis of the travel destination represented by the at least one real locational parameter and assigning a transportation vehicle to the user based upon the characterization.

9. A transportation system comprising:

a transportation system control means connected to a plurality of vehicles for serving travel destinations;

a storage means connected to said control means and storing a plurality of designations and real locational parameters assigned to said designations, said real locational parameters representing associated ones of the travel destinations; and at least one human-machine interface connected to said control means for entering said designations whereby said control means responds to an entered one of said designations by identifying at least one of said stored real locational parameters assigned to said one designation and said control means controls said vehicles for moving a user to the travel destination represented by the at least one real locational parameter.

10. The transportation system according to claim 9 wherein said one human-machine interface includes a display for visually displaying said designations.

11. The transportation system according to claim 9 wherein said one human-machine interface includes a display for visually displaying travel destination information generated by said control means.

* * * * *